US008066624B1

(12) United States Patent
Stroup

(10) Patent No.: US 8,066,624 B1
(45) Date of Patent: Nov. 29, 2011

(54) ERGONOMIC EXERCISE POSTURE CHAIR AND METHOD OF USING SAME

(76) Inventor: David K. Stroup, El Cajon, CA (US)

( * ) Notice: Subject to any disclaimer, the term of this patent is extended or adjusted under 35 U.S.C. 154(b) by 0 days.

(21) Appl. No.: 12/533,585

(22) Filed: Jul. 31, 2009

Related U.S. Application Data

(60) Provisional application No. 61/086,424, filed on Aug. 5, 2008.

(51) Int. Cl.
*A63B 21/02* (2006.01)

(52) U.S. Cl. ..... 482/121; 297/338

(58) Field of Classification Search ..... 482/34, 482/77, 79, 80, 121, 122, 123, 127, 128, 482/129, 130, 146, 147, 148; 446/325, 326; D21/686, 687, 688, 689; 472/1, 103, 104, 472/105; 297/338, 337
See application file for complete search history.

(56) References Cited

U.S. PATENT DOCUMENTS 2,550,992 A * 5/1951 Goodrich ..... 482/128
2,707,465 A * 5/1955 Nemeth ..... 601/87
4,186,920 A * 2/1980 Fiore et al. ..... 482/79
4,739,986 A * 4/1988 Kucharik et al. ..... 482/79
4,741,550 A * 5/1988 Dennis ..... 280/618
5,909,925 A * 6/1999 Glockl ..... 297/314
5,921,628 A * 7/1999 Glockl ..... 297/338
6,003,944 A * 12/1999 Glockl ..... 297/337
7,081,075 B2 * 7/2006 Sachs ..... 482/147
7,156,790 B2 * 1/2007 Johnsen ..... 482/146
7,547,067 B2 * 6/2009 Keilhauer et al. ..... 297/313
2008/0182736 A1 * 7/2008 Burrell ..... 482/142

* cited by examiner

*Primary Examiner* — Loan Thanh
*Assistant Examiner* — Tam Nguyen
(74) *Attorney, Agent, or Firm* — Stephen C. Beuerle; Procopio Cory Hargreaves & Savitch LLP

(57) ABSTRACT

An exercise chair includes a seat; a base having one or more base supports, the one or more base supports configured to contact a support surface; a seat support supporting the seat, pivotally connected to the base, and biased upward, the seat support including a fulcrum, and wherein downward pressure on the seat by a sitting user causes the fulcrum of the seat support to contact that support surface in addition to one or more of the one or more base supports, forcing the user to maintain a balanced posture on the seat in order to maintain the seat support in a vertical orientation.

12 Claims, 10 Drawing Sheets

ERGONOMIC EXERCISE POSTURE CHAIR AND METHOD OF USING SAME

CROSS-REFERENCE TO RELATED APPLICATION

This application claims the benefit of provisional patent application 61/086,424, filed Aug. 5, 2008, under 35 U.S.C. 119(e). This provisional patent application is incorporated by reference herein as though set forth in full.

FIELD OF THE INVENTION

The present invention generally relates to office chairs and seats (hereinafter "chairs"), and more particularly to ergonomic exercise chairs that enable one to strengthen one's core muscles while sitting.

BACKGROUND

Exercise balls are used to perform a variety of exercises to exercise one's core muscles. Exercise balls are large spherical flexible balls filled with air. Sometimes exercise balls are used by office workers to sit on while at one's desk. In this application, the exercise ball not only functions as a support for the office worker to sit on, but also enables one to strengthen one's core muscles while seated because the exercise ball has a tendency to roll if the office worker is not centered on top of the exercise ball.

Some of the problems with these exercise ball office chairs is that they are large, bulky, and do not look professional for an office environment.

SUMMARY

Accordingly, an aspect of the invention involves an ergonomic exercise posture chair that performs some of the same functions as the exercise ball (e.g., enables one to strengthen one's core muscles while seated), but looks like a more traditional office chair, making the ergonomic exercise posture chair much more suitable for an office environment.

Another aspect of the invention involves an exercise chair. The exercise chair includes a seat; a base having one or more base supports, the one or more base supports configured to contact a support surface; a seat support supporting the seat, pivotally connected to the base, and biased upward, the seat support including a fulcrum, and wherein downward pressure on the seat by a sitting user causes the fulcrum of the seat support to contact that the support surface in addition to one or more of the one or more base supports, forcing the user to maintain a balanced posture on the seat in order to maintain the seat support in a vertical orientation.

One or more implementations of the aspect of the invention described immediately above include or more of the following: the exercise chair is a stool exercise chair without a back and without armrests; the exercise chair is an office chair with a back and with armrests; the seat is a split seat assembly with separate, independent right and left seat members; the base includes a hub with a ball joint that the seat support is pivotally connected to; the base includes a plurality of radiating support arms; the one or more base supports include a plurality of wheeled based supports; the seat support is an elongated vertical seat support and the exercise chair includes a coil spring surrounding the elongated vertical support and biasing the elongated vertical support upward; the seat support is an elongated, vertical, tubular balance rod; the seat support includes an angular degree of freedom limiter mechanism that limits the pivotal angular degree of freedom of the seat support relative to the base between 0 and 15 degrees; the angular degree of freedom limiter mechanism limits the pivotal angular degree of freedom of the seat support relative to the base between 1 and 10 degrees; the angular degree of freedom limiter mechanism includes a plate secured to the seat support below the base and disposed above the fulcrum, and an adjustable fulcrum that is adjustable for controlling the distance between the fulcrum and plate; the plate is a disc; the disc includes a plurality of stops thereon; the exercise chair includes a lock that automatically locks the seat support in a vertical orientation relative to the base; the exercise chair includes a lock disengagement mechanism; the lock disengagement mechanism includes a lever to actuate the lock disengagement mechanism; the exercise chair includes a back and movable armrests, the movable armrests movable between a substantially horizontal position and a substantially vertical position, the lock disengagement mechanism actuatable to disengage the lock with movement of the movable armrests to the substantially vertical position; the lock disengagement mechanism actuatable to engage the lock to lock the seat support in a vertical orientation relative to the base with movement of the movable armrests to the substantially horizontal position; and/or a method of using the exercise chair of the aspect of the invention described immediately above includes sitting downward on the seat, applying downward pressure to the seat, the seat support, the base, and the one or more base supports; imparting downward movement to the seat support and the fulcrum; and causing the fulcrum of the seat support to contact that the support surface in addition to one or more of the one or more base supports, forcing the user to maintain a balanced posture on the seat in order to maintain the seat support in a vertical orientation.

Other features and advantages of the present invention will become more readily apparent to those of ordinary skill in the art after reviewing the following detailed description and accompanying drawings.

DETAILED DESCRIPTION

Certain embodiments as disclosed herein provide for an ergonomic exercise posture chair (hereinafter "exercise chair") 50 and method of using the exercise chair 50.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in any appended claims.

Figure 1:
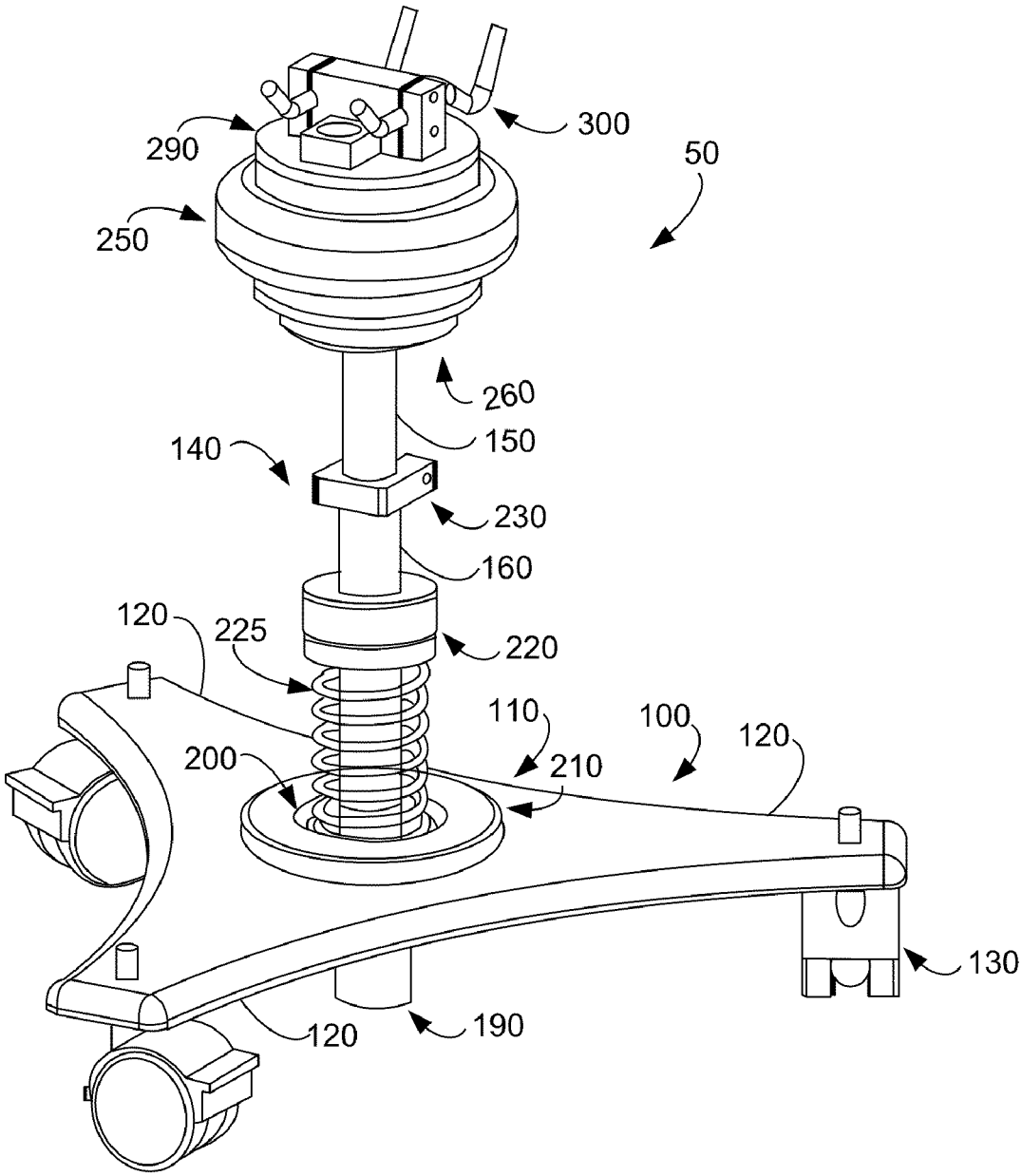
FIG. 1 is a perspective view of an embodiment of an exercise chair.
Figure 2:
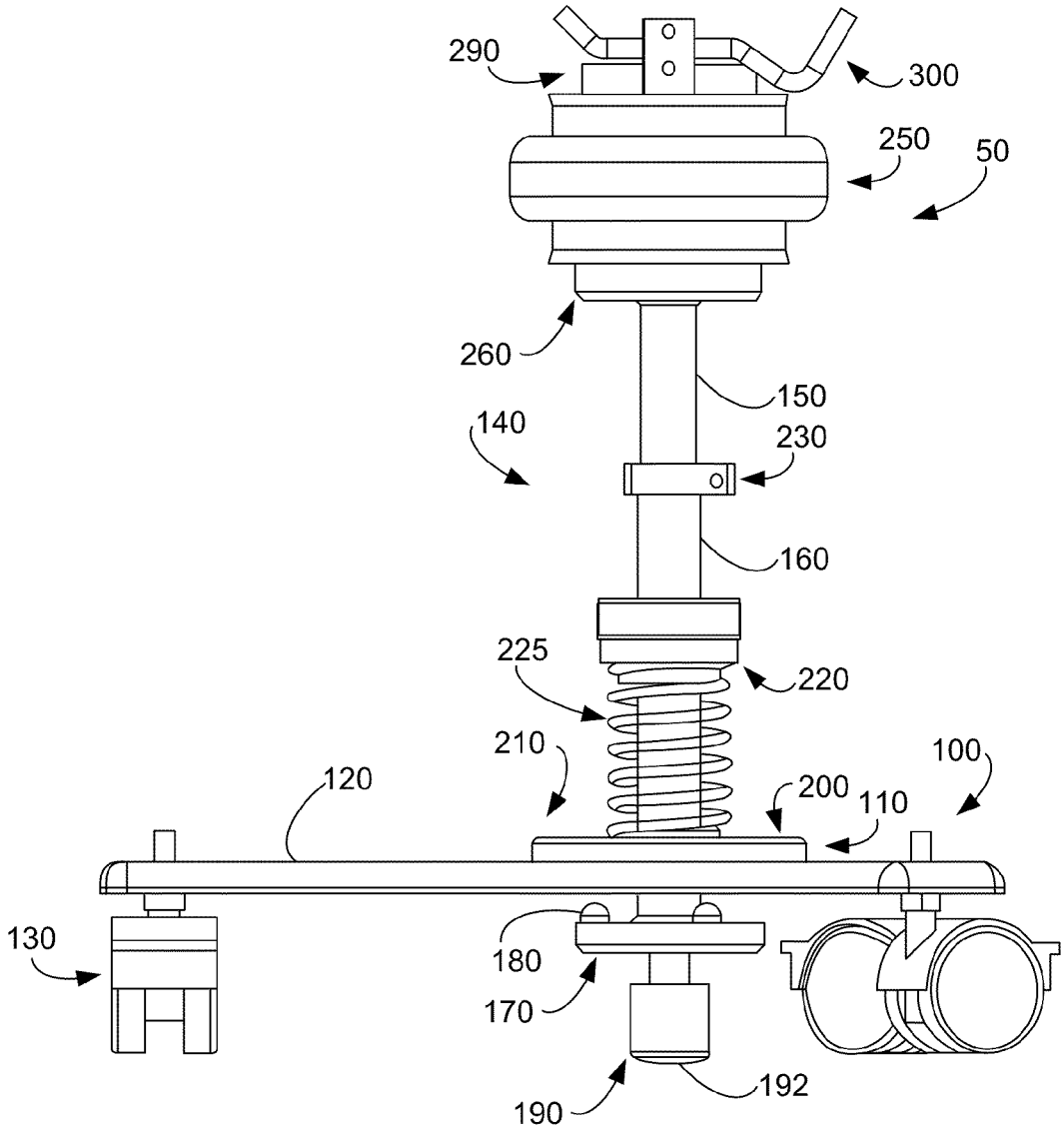
FIG. 2 is a front elevational view of the exercise chair of FIG. 1 and shows the exercise chair with pressure shown centered and applied vertically downward on the exercise chair.
Figure 3:
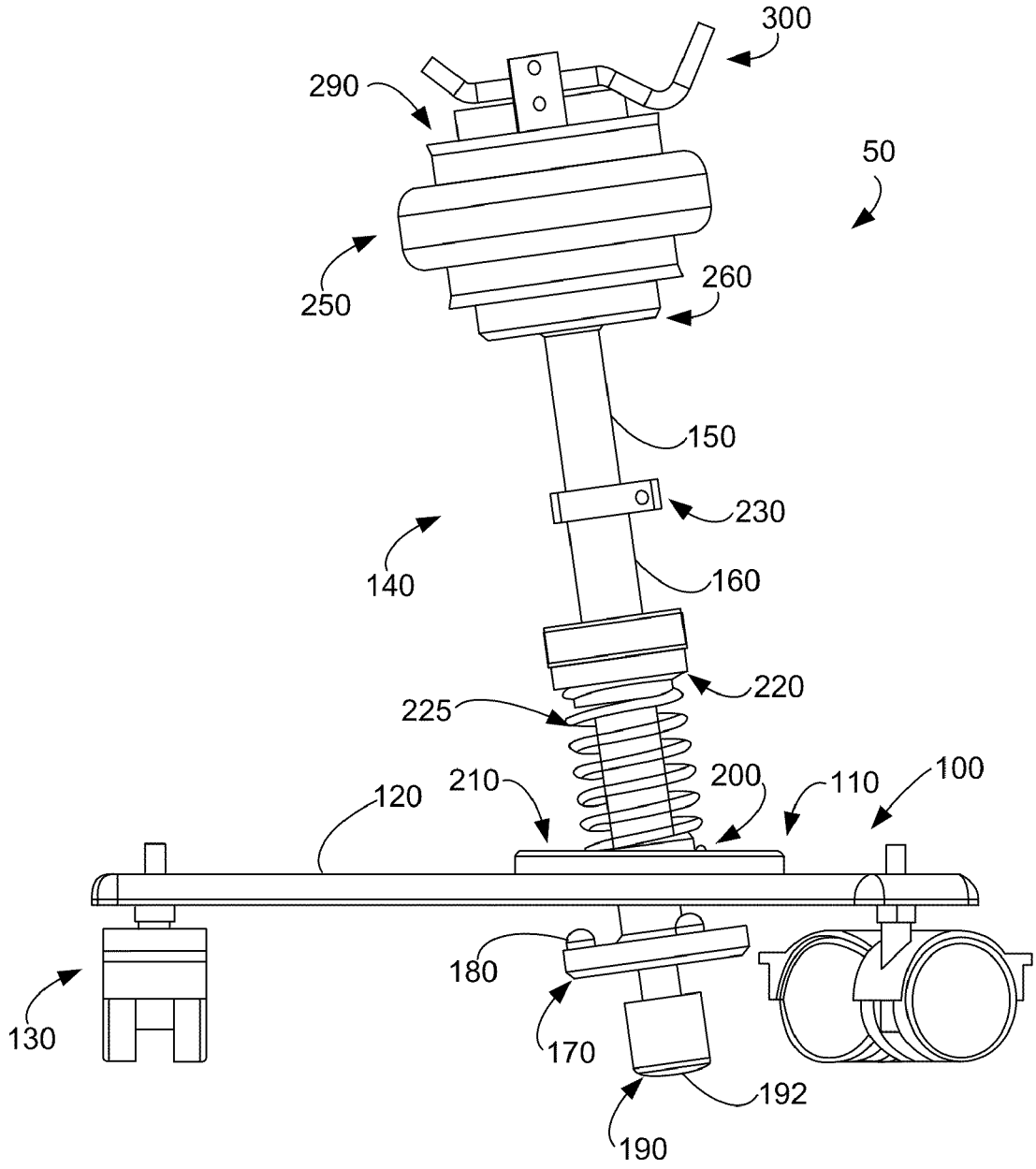
FIG. 3 is a front elevational view of the exercise chair of FIG. 1 and shows the exercise chair with pressure shown off-centered and applied vertically downward on the exercise chair.
Figure 4:
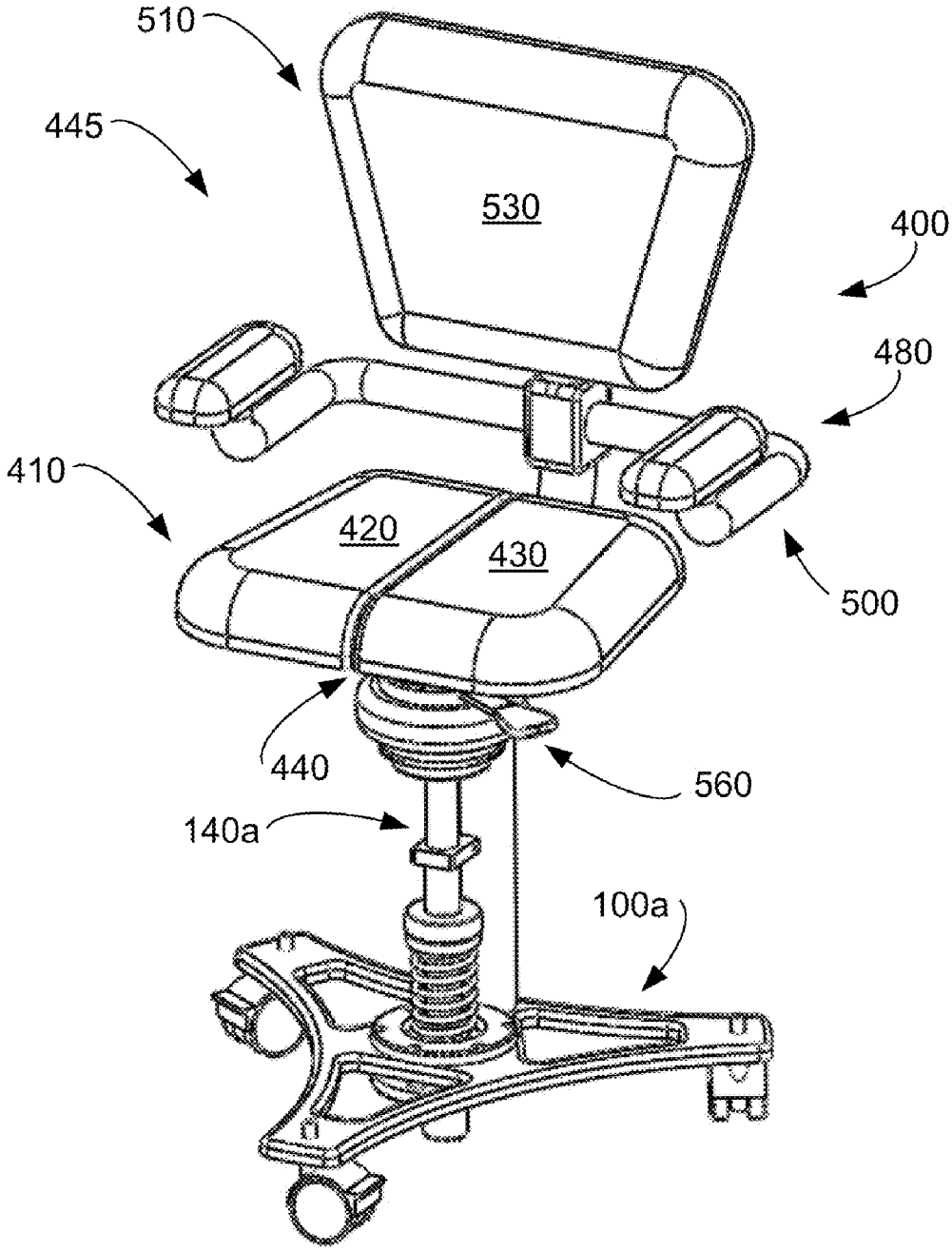
FIG. 4 is a front, top perspective view of another embodiment of an exercise chair.
Figure 5:
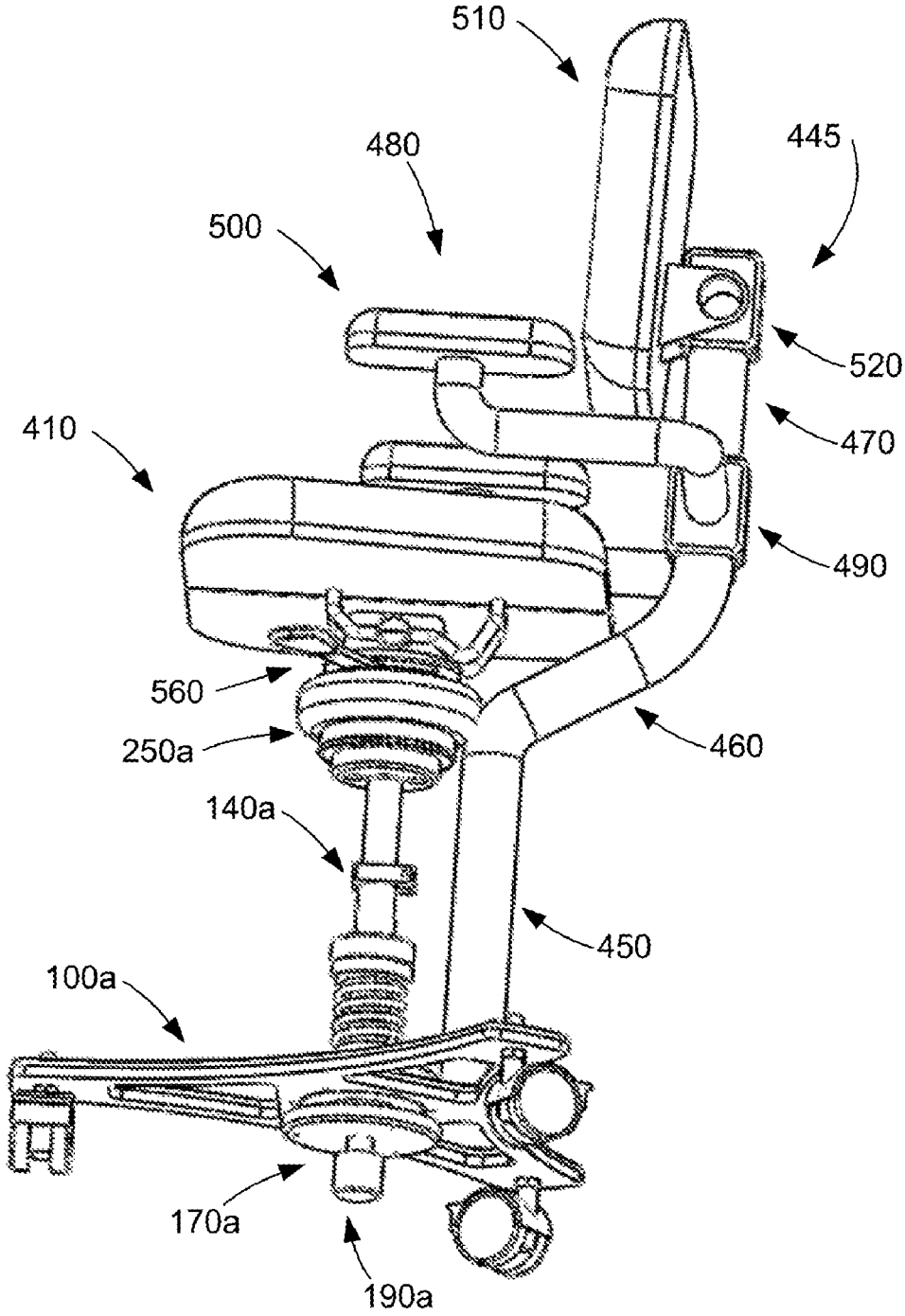
FIG. 5 is a right side, bottom perspective view of the exercise chair of FIG. 4.
Figure 6:
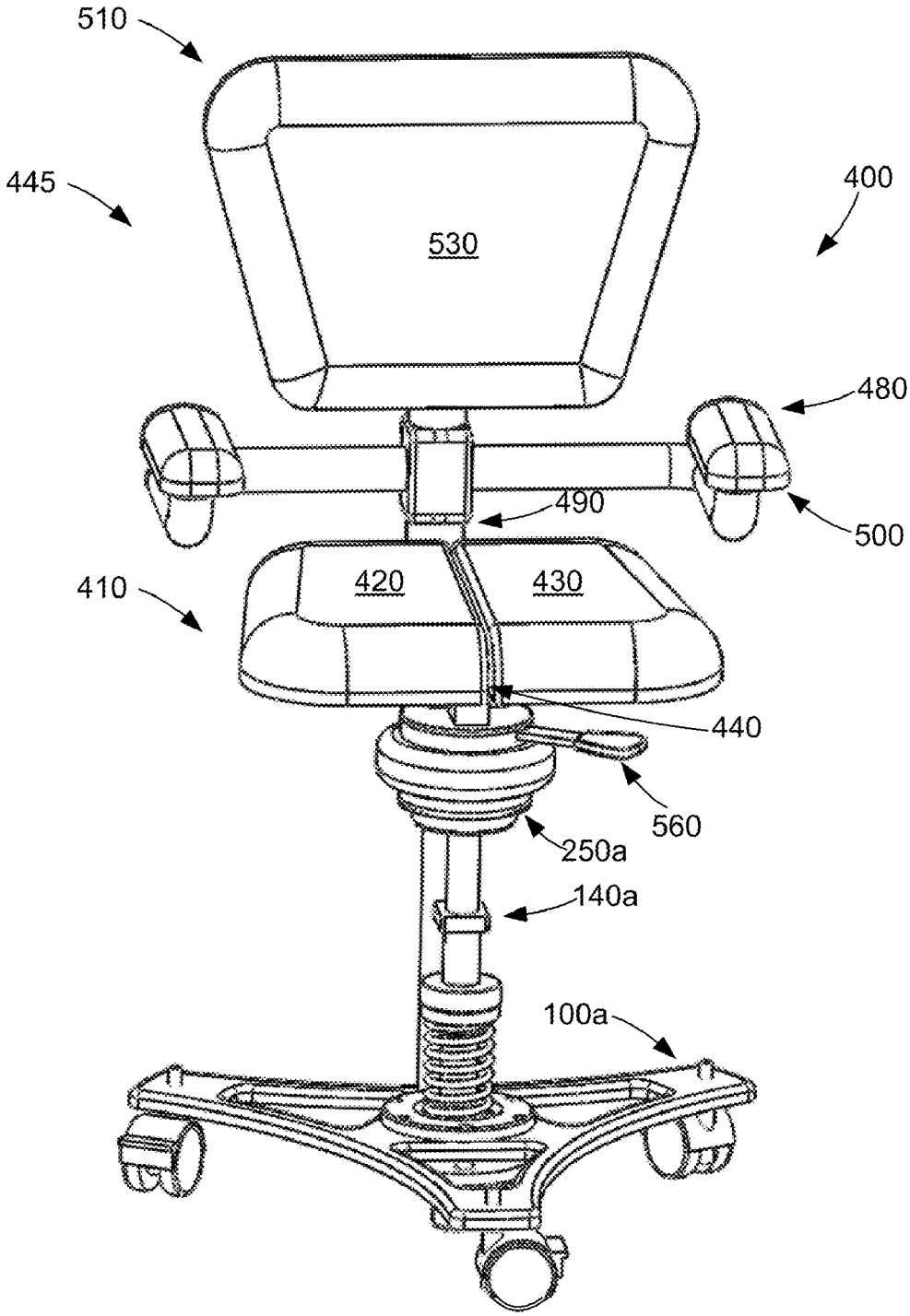
FIG. 6 is another front, top perspective view of exercise chair of FIG. 4.

With reference to FIGS. 1-3, an embodiment of an exercise chair 50 includes a base 100 with a central hub 110 and three or more (e.g., 4, 5) radiating arms 120. Casters or wheeled supports 130 are secured to distal ends of the arms 120 for supporting the base 100 and enabling rolling movement of the base 100 on a support surface (e.g., floor).

A tubular balance rod or vertical support 140 includes a lower portion pivotally and rotatably coupled to the base 100 at the hub 110. The balance rod 140 includes an upper tubular pole 150 telescopingly received in a lower tubular pole 160. The lower tubular pole 160 terminates in a flange/disc/plate 170. Rubber stops 180 are disposed in an upper part of the flange 170. A rubber balance support or fulcrum 190 extends downwardly from a lower part of the flange 170. The balance support 190 may have a convex end 192 that contact the support surface (e.g., floor) as described further below.

A lower spring-receiving section 200 is disposed in a top portion of a ball joint 210 of the hub 110. A lower portion of the lower tubular pole 160 is pivotally and rotatably coupled to the base 100 via the ball joint 210. The lower tubular pole 160 includes an upper spring-receiving section 220 spaced vertically from the lower spring-receiving section 200. A compression spring 225 is disposed between the upper spring-receiving section 220 and the lower spring-receiving section 200.

A connector bracket 230 connects the lower pole 160 to the upper pole 150.

In the embodiment shown, air-filled bellows 250 are disposed at a top of the balance rod 140. The bellows 250 adds a "cushioning" effect and adds controlled instability/play (i.e., between the balance rod 150 and the seat/seat assembly) to the exercise chair 50. The bellows 250 are controllable/lockable for controlling the instability/play in the exercise chair 50 and may be locked to zero instability/play. In alternative embodiments, the exercise chair 50 does not include bellows 250 or the bellows are replaced by a controlled instability mechanism that adds controlled instability/play to the exercise chair 50. The connection section 260 is connected to the top of the balance rod 140 by a coupler. The lower connection section 260 is connected to a bottom of the bellows 250 via fasteners. An upper connection section 290 is connected to the top of the bellows 250 via fasteners.

A seat connector 300 is coupled to the upper connection section 290.

Different style seats are attached to the seat frame 300. For example, but not by way of limitation, in an application of the exercise chair 50 where the exercise chair 50 has a stool-like application, which may or may not be used for an office environment, a seat (without a back) is attached to the seat frame 300. In another application of the exercise chair 50 where the exercise chair 50 is used in an office environment, a seat, seat back, and arm rests are coupled to the seat frame 300.

The exercise chair 50 will now be described in use. A user sits on the exercise chair 50. When this happens, the downward force and shock from the sudden downward force (from the user's weight) is partially absorbed by the bellows 250. The downward force causes the balance rod 140 to move downwardly through the ball joint 210, relative to the ball joint 210/base 100. As the balance rod 140 moves downwardly, the upper spring-receiving section 220 causes the compression spring 225 to be compressed. As the spring 225 is compressed, it exerts an upward force on the balance rod 140 (i.e., trying to return the balance rod 140 to its original, non-compressed position). When the balance rod 140 moves downward a sufficient distance, as shown in FIGS. 2 and 3, the exercise chair 50 no longer is supported solely by the casters 130. Instead, the balance support/fulcrum 190 becomes the primary support for the exercise chair 50. With the balance support/fulcrum 190 as the primary support for the exercise chair 50, as shown in FIG. 3, if the user is off balance on the exercise chair 50 (e.g., body weight, center of gravity is not centered on the exercise chair 50), the balance rod 140 will pivot/rotate within the ball joint 210 and the exercise chair 50 will be off balance. The convex end 192 (or a variety of different replaceable configuration ends and/or balance supports 190) can be used to make the exercise chair 50 easier or more difficult to balance. To re-gain balance and maintain the balance rod 140 in the vertical position, perpendicular to the support surface (e.g., floor), as shown in FIG. 2, the user has to use the muscles in one's core/mid-section and use one's legs to balance, exercising and strengthening these muscles while simultaneously being supported by the exercise chair 50.

Thus, the exercise chair 50 exercises and strengthens one's core muscles while simultaneously supporting the user. As indicated above, the exercise chair 50 may include different versions, some of which are designed for office use. For example, the exercise chair 50 may include a stool seat version without a seat back/arm rests and the exercise chair 50 may include an office chair version with a seat back/arm rests. The exercise chair 50 functions in a similar manner to exercise ball office chairs, but the exercise chair 50 is much smaller, less bulky, and more professional/suitable for an office environment.

With reference to FIGS. 4-8, another embodiment of an exercise chair 400 will be described. Much of the exercise chair 400 is similar to the exercise chair 50 described above with respect to FIGS. 1-3. Similar elements will be shown with like references numbers, but with an "a" suffix, and will not be described below.

The exercise chair 400 includes a seat or seat assembly 410 that is secured to and supported by the seat connector **300*a*. The seat assembly 410 is a split seat assembly with separate right and left seat members, 420, 430 that flex independently. The right and left seat members, 420, 430, independently and respectively support the right and left glutes/lats/rear of a user. The seat members 420, 430 are substantially rectangular with rounded edges and outer corners. A small linear gap 440** separates the right and left seat members along their inner length. In an alternative embodiment, the seat/seat assembly is a single seat assembly (i.e., does not include separate seat members).

As indicated above, the exercise chair may include a stool seat version without a seat back/arm rests and may include an office chair version with a seat back/arm rests.

Figure 7:
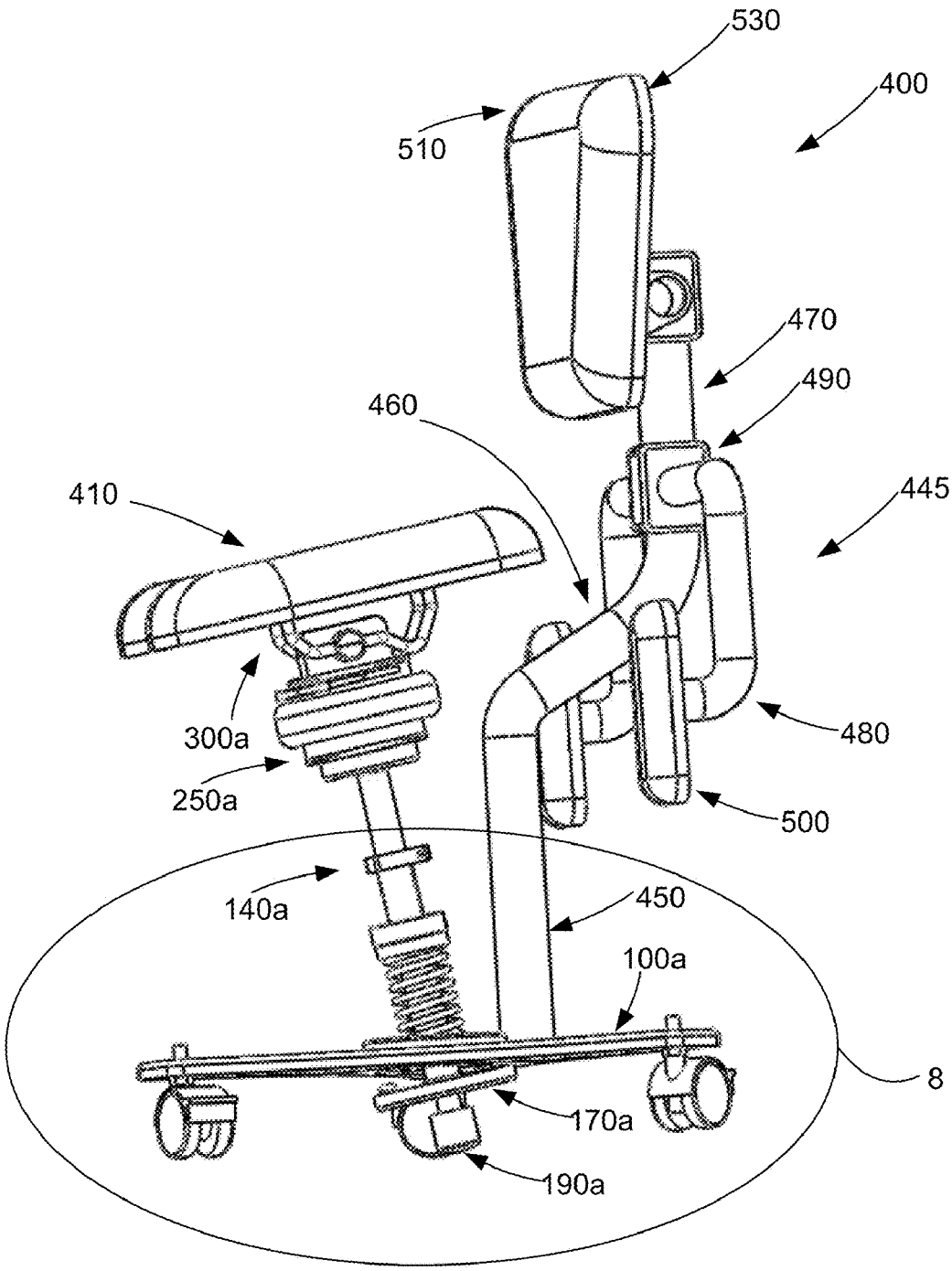
FIG. 7 is right side elevational view of exercise chair of FIG. 4.
Figure 8:
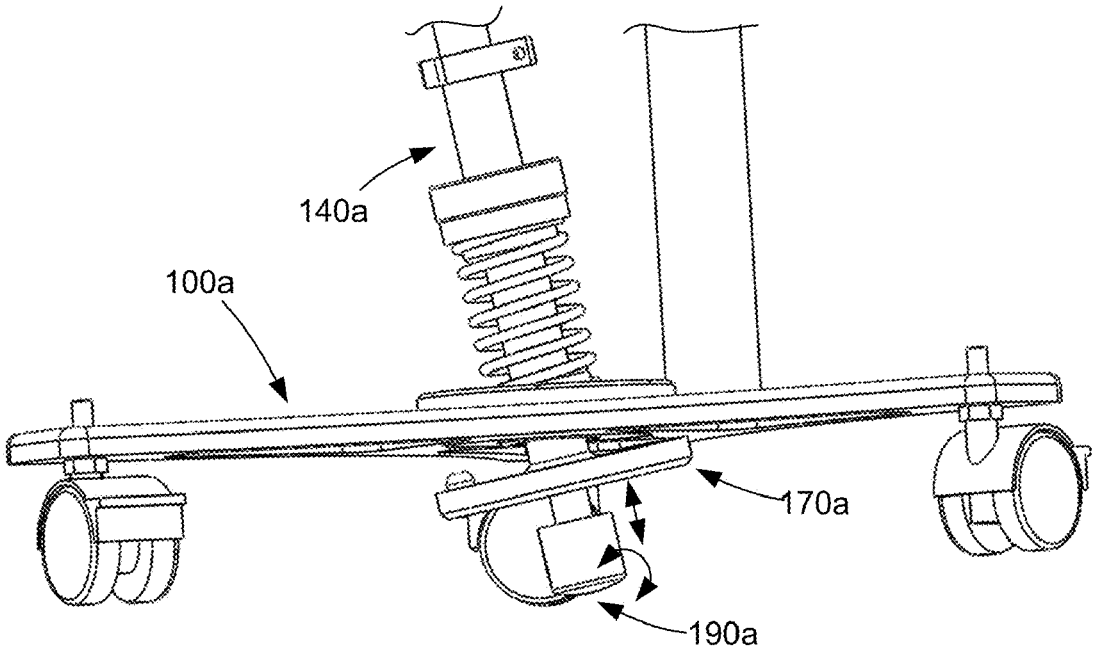
FIG. 8 is an enlarged right side elevational view of area 8 of FIG. 7.

With reference to FIGS. 7 and 8, a seat back and arm rest assembly 445 of the exercise chair 400 will be described. The seat back and arm rest assembly 445 includes a lower vertical support 450 connected to and extending vertically from a rear of the base 100*a*. A rearward angled member/portion 460 extends rearwardly and upwardly from a top of the lower vertical support 450. An upper vertical support 470 extends vertically from a top of the rearward angled member/portion 460.

An arm rest assembly 480 is connected to the upper vertical support 470 via a coupler 490. The coupler 490 allows pivotal movement of armrests 500 between at least a horizontal position (FIG. 4) and a vertical position (e.g., vertically down position; FIG. 7). In an embodiment of the exercise chair 400, a lock disengagement mechanism includes the pivotal/moveable armrests 500 and movement of the armrests 500 to the down position (FIG. 7) may unlock the balance rod 140*a* (e.g., unlock the balance rod 140*a* via lock 570 to unlock the flange/disc 170*a*) from/relative to the base 100*a* to enable/activate the balancing/exercising features of the exercise chair 400. Movement of the armrests 500 to the horizontal position (FIG. 4) may lock the balance rod 140*a* (e.g., lock the balance rod 140*a* via lock 570 to lock the flange/disc 170*a*) to/relative to the base 100*a* (i.e., lock 570 prevents the flange/disc 170*a* from lowering from the base 100*a*) to disenable/deactivate the balancing/exercising features of the exercise chair 400.

A back support assembly 510 is connected to a top of the upper vertical support 470 via a coupler 520. The back support assembly 510 includes a trapezoid-shaped back support 530 with rounded edges and outer corners.

In an embodiment of the invention, with the armrests 500 in the horizontal position (FIG. 4), disenabling/deactivating the balancing/exercising features of the exercise chair 400, and the additional back support offered by the back support assembly 510, the exercise chair 400 may be used as a regular office chair. With the armrests 500 in the vertical position (FIG. 7), enabling/activating the balancing/exercising features of the exercise chair 400, the balancing/exercising features of the exercise chair 400 may be used.

Figure 9:
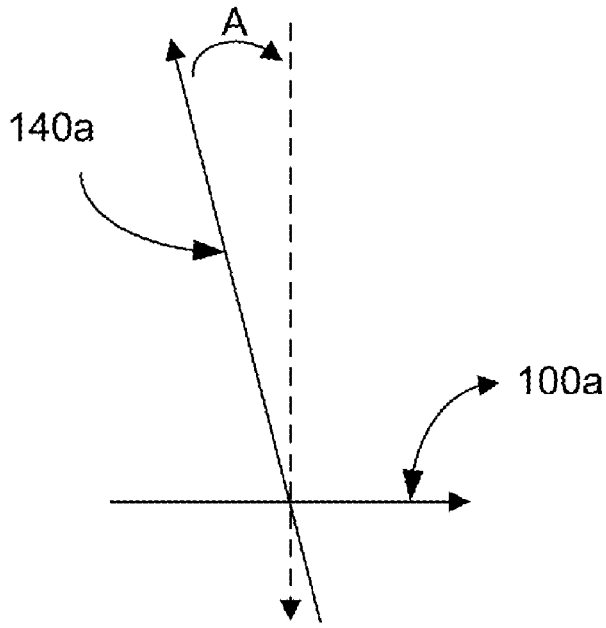
FIG. 9 is a simplified view illustrating the angular degrees of freedom of the exercise chair.
Figure 10:
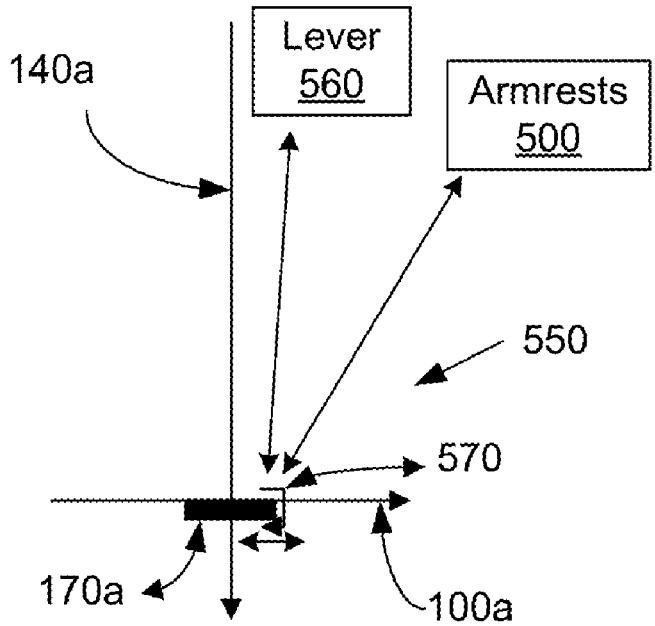
FIG. 10 is a simplified view illustrating an embodiment of a lock for locking the balance rod relative to a base, the lock automatically actuated and disengaged by a lever and/or armrest(s).
Figure 11:
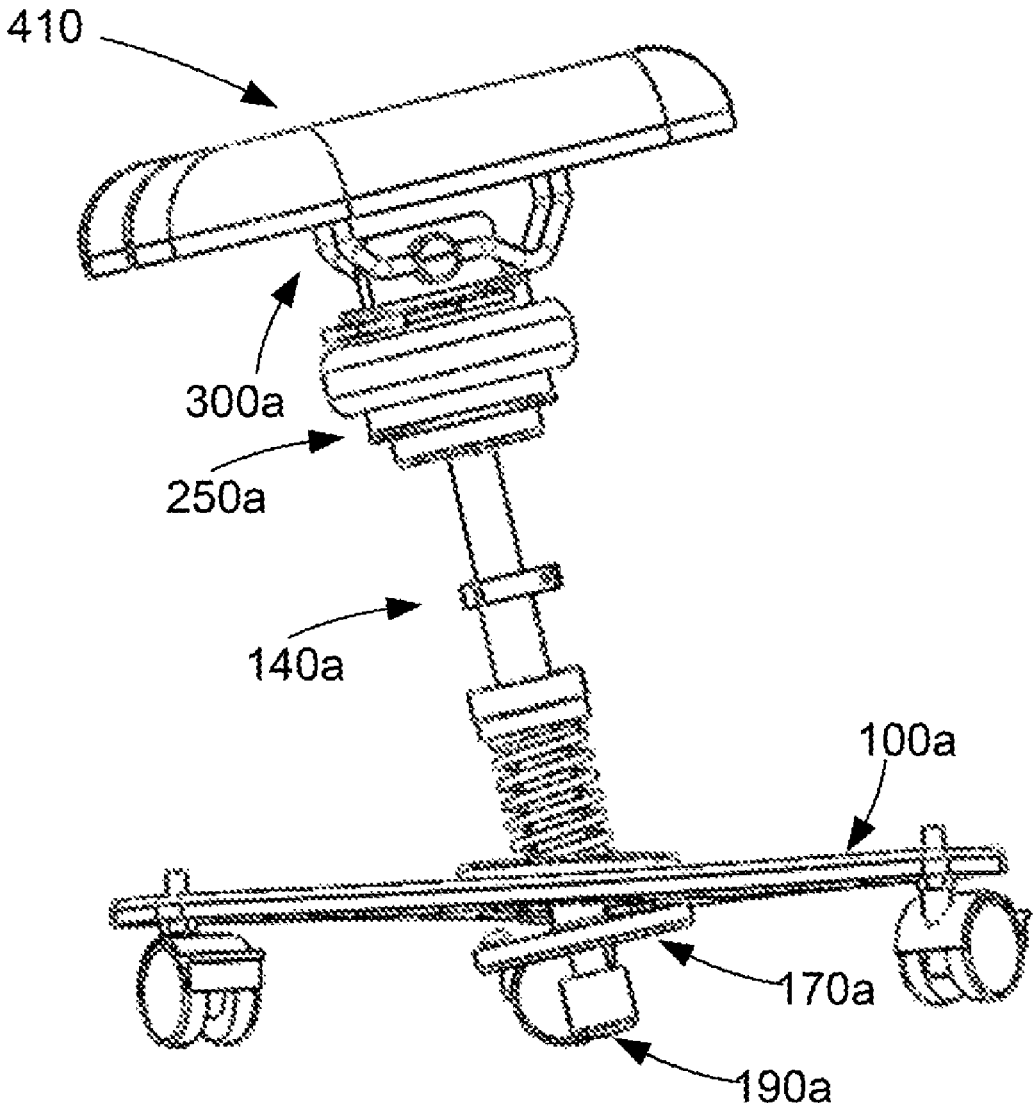
FIG. 11 is a right side elevational view of the exercise chair without a seatback or arm rests.

With reference to FIGS. 8 and 9, an angular degree of freedom limiter mechanism will be described. The fulcrum 190*a* is adjustable to adjust the distance between the fulcrum 190*a* and the flange 170*a* (i.e., adjust the range of travel), which limits angular degree of freedom as it abuts the bottom of the base 100 or hub 110, for adjusting the angular degree of freedom A of the balance rod 140*a* relative to the base 100*a* between 0 and 15 degrees, and between 1 and 10 degrees in a more preferred embodiment. For example, but not by way of limitation, the fulcrum 190*a* may threadably engage the a bottom of the balance rod 140 so that rotation (e.g., clockwise) decreases the distance between the fulcrum 190*a* and the flange 170*a*, adjusting the range of travel and enabling a lesser degree of freedom of the balance rod 140*a* relative to the base 100*a* and opposite rotation (e.g., counter-clockwise) increases the distance between the fulcrum 190*a* and the flange 170*a*, enabling a greater degree of freedom of the balance rod 140*a* relative to the base 100*a*.

In alternative embodiments, other mechanisms/means such as, but not by way of limitation, the bellows 250 (e.g., adjusting the air in the bellows 250 allowing more/less play), different configuration/size attachable/detachable fulcrums 190*a* may be used to enable greater/lesser angular degree of freedom of the balance rod 140*a* relative to the base 100*a*.

With reference to FIGS. 4-6 and 10, an unlocking mechanism 550 enables a user to enable/activate the balancing/exercising features of the exercise chair 400. In the embodiment shown, a lock disengagement mechanism includes a lever 560 that is operably coupled to a lock 570 whereby movement of the lever 560 imparts movement to the lock 570 to unlock the balance rod 140*a* (e.g., unlock the balance rod 140*a* via unlocking the flange/disc 170*a*) from/relative to the base 100*a* to enable/activate the balancing/exercising features of the exercise chair 400.

When a user gets off the exercise chair 400, the compression spring 225 causes the balance rod 140 to return to its normal position and the lock 570 is configured (e.g., via a spring, lever, and/or other mechanical mechanism) to automatically lock the balance rod 140*a* (e.g., lock the balance rod 140*a* via locking the flange/disc 170*a*) to/relative to the base 100*a* to disenable/deactivate the balancing/exercising features of the exercise chair 400 so that the chair 400 is usable as a normal chair.

Thus, in one or more embodiments, the lock disengagement mechanism includes the armrest(s) 500 and/or the lever 560 to disengage the lock 570 to enable/activate the balancing/exercising features of the exercise chair 400.

In alternative embodiments, the lock 570 has an alternative configuration and/or locks different elements that that shown and described herein.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus, the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. An exercise chair, comprising:

a seat;

a base having one or more base supports, the one or more base supports configured to contact a support surface;

a seat support supporting the seat, pivotally connected to the base, and biased upward, the seat support including a fulcrum and an initial vertical axis, wherein downward pressure on the seat by a sitting user causes the fulcrum of the seat support to contact the support surface and causes the seat support to pivot on the fulcrum forcing the user to maintain a balanced posture on the seat in order to maintain the seat support in a vertical orientation, and the seat support includes an angular degree of freedom limiter mechanism that limits the pivotal angular degree of freedom of the seat support relative to the initial vertical axis.

2. The exercise chair of claim 1, wherein the base includes a hub with a ball joint that the seat support is pivotally connected to.

3. The exercise chair of claim 1, wherein the base includes a plurality of radiating support arms.

4. The exercise chair of claim 1, wherein the one or more base supports include a plurality of wheeled based supports.

5. The exercise chair of claim 1, wherein the seat support is an elongated vertical seat support and the exercise chair includes a coil spring surrounding the elongated vertical support and biasing the elongated vertical support upward.

6. The exercise chair of claim 5, wherein the seat support is an elongated, vertical, tubular balance rod.

7. The exercise chair of claim 1, wherein the angular degree of freedom limiter mechanism limits the pivotal angular degree of freedom of the seat support relative to the initial vertical axis between 1 and 10 degrees.

8. The exercise chair of claim 1, wherein the angular degree of freedom limiter mechanism includes a plate secured to the seat support below the base and disposed above the fulcrum, and an adjustable fulcrum that is adjustable for controlling the distance between the fulcrum and plate.

9. The exercise chair of claim 8, wherein the plate is a disc.

10. The exercise chair of claim 8, wherein the disc includes a plurality of stops thereon.

11. A method of using the exercise chair of claim 1, comprising:

sitting downward on the seat, applying downward pressure to the seat, the seat support, the base, and the one or more base supports;

imparting downward movement to the seat support and the fulcrum;

causing the fulcrum of the seat support to contact the support surface; and causing the seat support to pivot on the fulcrum, forcing the user to maintain a balanced posture on the seat in order to maintain the seat support in a vertical orientation.

12. An exercise chair, comprising:

a seat;

a base having one or more base supports, the one or more base supports configured to contact a support surface;

a seat support supporting the seat, pivotally connected to the base, and biased upward, the seat support including a fulcrum and an initial vertical axis, wherein downward pressure on the seat by a sitting user causes the fulcrum of the seat support to contact the support surface, forcing the user to maintain a balanced posture on the seat in order to maintain the seat support in a vertical orientation, wherein the seat support includes an angular degree of freedom limiter mechanism that limits the pivotal angular degree of freedom of the seat support relative to the initial vertical axis between 0 and 15 degrees.

* * * * *